US011244604B2

(12) United States Patent
Zheng

(10) Patent No.: US 11,244,604 B2
(45) Date of Patent: Feb. 8, 2022

(54) PIXEL COMPENSATION CIRCUIT, DISPLAY SUBSTRATE, AND DISPLAY DEVICE

(71) Applicant: CHONGQING KONKA PHOTOELECTRIC TECHNOLOGY RESEARCH INSTITUTE CO., LTD., Chongqing (CN)

(72) Inventor: Shisong Zheng, Chongqing (CN)

(73) Assignee: CHONGQING KONKA PHOTOELECTRIC TECHNOLOGY RESEARCH INSTITUTE CO., LTD., Chongqing (CN)

( * ) Notice: Subject to any disclaimer, the term of this patent is extended or adjusted under 35 U.S.C. 154(b) by 0 days.

(21) Appl. No.: 17/172,774

(22) Filed: Feb. 10, 2021

(65) Prior Publication Data

US 2021/0217355 A1 Jul. 15, 2021

Related U.S. Application Data

(63) Continuation of application No. PCT/CN2020/073074, filed on Jan. 20, 2020.

(30) Foreign Application Priority Data

Jan. 15, 2020 (CN) ..... 202010043592.0

(51) Int. Cl.
*G09G 3/32* (2016.01)
*G09G 3/3258* (2016.01)
(Continued)

(52) U.S. Cl.
CPC ..... *G09G 3/32* (2013.01); *G09G 3/006* (2013.01); *G09G 3/3233* (2013.01);
(Continued)

(58) Field of Classification Search
CPC ..... G09G 3/30; G09G 3/32; G09G 3/3208; G09G 3/3225; G09G 3/3233;
(Continued)

(56) References Cited

U.S. PATENT DOCUMENTS 8,803,770 B2 * 8/2014 Jeong ..... G09G 3/3233 345/76
10,276,094 B2 * 4/2019 Xiang ..... G09G 3/3258
(Continued)

FOREIGN PATENT DOCUMENTS

CN 102257555 A 11/2011
CN 105448244 A 3/2016
(Continued)

OTHER PUBLICATIONS

International Search Report issued in corresponding International Application No. PCT/CN2020/073074, dated Oct. 21, 2020, pp. 1-12, Beijing, China.

*Primary Examiner* — Jason M Mandeville
(74) *Attorney, Agent, or Firm* — Hauptman Ham, LLP

(57) ABSTRACT

A pixel compensation circuit is provided. The pixel compensation circuit includes a detecting circuit, a repairing circuit, a compensating circuit, and a light-emitting device. The detecting circuit is electrically coupled with the repairing circuit, the compensating circuit, and the light-emitting device. The compensating circuit is configured to provide a fixed current to the light-emitting device. The detecting circuit is configured to detect a current flowing through the light-emitting device. The repairing circuit is configured to determine a compensation current according to the current detected by the detecting circuit and input the compensation current into the light-emitting device. A display substrate and a display device are further provided.

11 Claims, 12 Drawing Sheets

(51) Int. Cl.
*G09G 3/3233* (2016.01)
*G09G 3/00* (2006.01)

(52) U.S. Cl.
CPC ... *G09G 3/3258* (2013.01); *G09G 2300/0809* (2013.01); *G09G 2300/0819* (2013.01); *G09G 2320/04* (2013.01); *G09G 2330/10* (2013.01)

(58) Field of Classification Search
CPC ..... G09G 3/3258; G09G 2320/0233; G09G 2320/0295; G09G 2320/04; G09G 2300/0809; G09G 3/006; G09G 2300/0819; G09G 2330/10
USPC ..... 345/690, 76
See application file for complete search history.

(56) References Cited

U.S. PATENT DOCUMENTS

| | | | | |
|---|---|---|---|---|
| 10,971,076 | B2 * | 4/2021 | Kawachi | G09G 3/3275 |
| 2012/0085694 | A1 | 4/2012 | Hu et al. | |
| 2017/0110054 | A1 * | 4/2017 | Sun | G09G 3/3291 |
| 2018/0357962 | A1 * | 12/2018 | Feng | G09G 3/3258 |
| 2019/0096321 | A1 * | 3/2019 | Yang | H01L 27/124 |
| 2019/0287452 | A1 * | 9/2019 | Wang | G09G 3/3233 |

FOREIGN PATENT DOCUMENTS

| | | | |
|---|---|---|---|
| CN | 105931600 | A | 9/2016 |
| CN | 106067291 | A | 11/2016 |
| CN | 106504706 | A | 3/2017 |
| CN | 108492779 | A | 9/2018 |
| CN | 108711400 | A | 10/2018 |
| CN | 108877685 | A | 11/2018 |
| CN | 109935205 | A | 6/2019 |
| CN | 110097842 | A | 8/2019 |
| CN | 210896557 | U | 6/2020 |

* cited by examiner

PIXEL COMPENSATION CIRCUIT, DISPLAY SUBSTRATE, AND DISPLAY DEVICE

CROSS-REFERENCE TO RELATED APPLICATIONS

This application is a continuation of International Application No. PCT/CN2020/073074, filed on Jan. 20, 2020, which claims priority to Chinese Application No. CN 202010043592.0, filed Jan. 15, 2020, the entire disclosure of which are incorporated herein by reference.

TECHNICAL FIELD

This disclosure relates to the field of display technology, and more particularly to a pixel compensation circuit, a display substrate, and a display device.

BACKGROUND

Electroluminescence (EL) devices include an organic light-emitting diode (OLED), a light-emitting diode (LED), and other devices. In recent years, an EL device has been widely used in production of display products. Compared with a traditional cathode ray tube (CRT) display, a liquid crystal display (LCD), or the like, the EL device has shown better optical characteristics, lower power consumption, and better product formability. During manufacturing of a display, manufacturing of a drive circuit (usually composed of a field-effect transistor and a capacitor) block and manufacturing of the EL device are separate processes. Therefore, if a current-controlled light emission function needs to be achieved, it must be implemented through a bonding process. However, the bonding process will often result in an electrical defect due to pre-process defects (for example, pollution interference, equipment errors, or other unexpected factors), which will reduce a conduction current of the EL device. As illustrated in FIG. 1 and FIG. 2, if the EL device is in good contact with a circuit that is connected with the EL device, $R_E=0$ and $V_D=0$. If there is a misalignment or a foreign object between the EL device and the circuit, a significant resistance will be produced, that is, $R_E>0$ and $V_D>0$, which will result in an additional voltage difference $\Delta V$, decrease in a voltage across the EL device, decrease in drive current $I_{EL}$, and decrease in luminous current. This will cause decrease in brightness and thus lead to a lower yield.

Therefore, the related art is in need of improvement and development.

SUMMARY

Considering disadvantages of the related art described above, implementations provide a pixel compensation circuit, a display substrate, and a display device.

Technical solutions of implementations are as follows.

In a first aspect, a pixel compensation circuit is provided. The pixel compensation circuit includes a detecting circuit, a repairing circuit, a compensating circuit, and a light-emitting device. The detecting circuit is electrically coupled with the repairing circuit, the compensating circuit, and the light-emitting device. The compensating circuit is configured to provide a fixed current to the light-emitting device. The detecting circuit is configured to detect a current flowing through the light-emitting device. The repairing circuit is configured to determine a compensation current according to the current detected by the detecting circuit and input the compensation current into the light-emitting device.

In some implementations, the detecting circuit includes a first transistor, a second transistor, and a third transistor. The first transistor has a first end coupled with a positive electrode of a power supply, a second end coupled with a first end of the second transistor, and a gate coupled with a light-emission control signal line. The second transistor has a second end coupled with a first end of the third transistor and a gate coupled with a first control signal line. The third transistor has a second end coupled with an anode of the light-emitting device and a gate coupled with the light-emission control signal line. The light-emission control signal line is configured to provide a light-emission control signal which is used for controlling an on/off state of the first transistor and the third transistor. The first control signal line is configured to provide a first control signal which is used for controlling an on/off state of the second transistor. The repairing circuit is coupled with a common connection end between the second end of the second transistor and the first end of the third transistor.

In some implementations, the repairing circuit includes a fourth transistor. The fourth transistor has a first end coupled with the common connection end between the second end of the second transistor and the first end of the third transistor, a second end coupled with the positive electrode of the power supply, and a gate coupled with a repair-voltage line.

In some implementations, the compensating circuit includes a fifth transistor, a sixth transistor, a seventh transistor, and a first capacitor. The fifth transistor has a first end coupled with the positive electrode of the power supply, a second end coupled with a second end of the first capacitor, and a gate coupled with a first end of the first capacitor. The sixth transistor has a first end coupled with the second end of the first capacitor, a second end coupled with an adjustable-fixed-current line, and a gate coupled with a scanning control signal line. The seventh transistor has a first end coupled with a reference voltage line, a second end coupled with the first end of the first capacitor, and a gate coupled with the scanning control signal line. The second end of the first capacitor is coupled with the first end of the first transistor.

In some implementations, the pixel compensation circuit further includes a resetting module. The resetting module is electrically coupled with the scanning control signal line, the anode of the light-emitting device, and a negative electrode of the power supply and is configured to reset the light-emitting device.

In some implementations, the resetting module includes an eighth transistor. The eighth transistor has a first end coupled with the anode of the light-emitting device, a second end coupled with the negative electrode of the power supply, and a gate coupled with the scanning control signal line.

In some implementations, the scanning control signal line is configured to provide a second control signal which is used for controlling an on/off state of the sixth transistor, the seventh transistor, and the eighth transistor.

In some implementations, the first transistor, the second transistor, the third transistor, the fifth transistor, the sixth transistor, the seventh transistor, and the eighth transistor are each an N-type transistor.

In some implementations, the light-emitting device is an electroluminescence (EL) device.

In a second aspect, a display substrate is provided. The display substrate includes multiple pixel units. Each of the multiple pixel units includes the pixel compensation circuit described in the first aspect.

In a third aspect, a display device is provided. The display device includes the display substrate described in the second aspect.

BRIEF DESCRIPTION OF THE DRAWINGS

In order to describe more clearly technical solutions of implementations or in the related art, the following will give a brief introduction to accompanying drawings used for describing implementations or the related art. Apparently, the accompanying drawings described below are merely some implementations of the disclosure. Based on these drawings, those of ordinary skill in the art can also obtain other drawings without creative effort.

DETAILED DESCRIPTION

Figure 1:
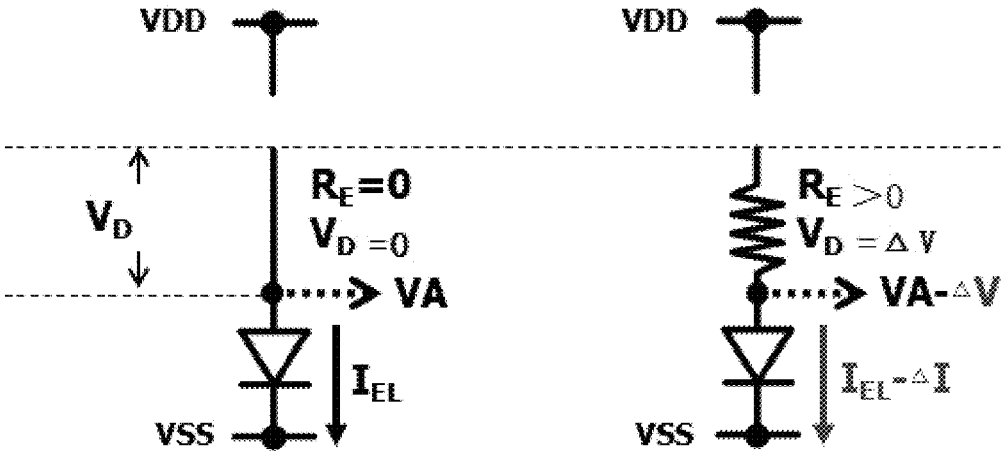
PRIOR ART FIG. 1
FIG. 1 is a schematic diagram illustrating driving of an EL device in the related art.
Figure 2:
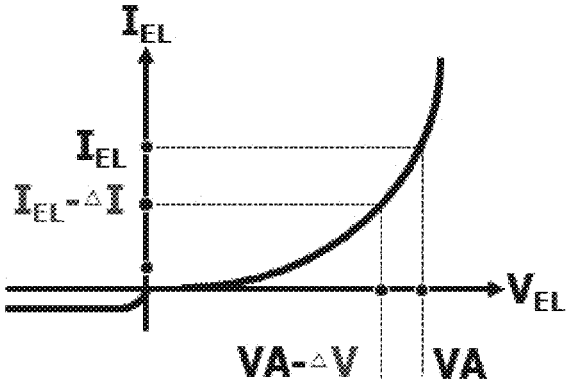
PRIOR ART FIG. 2
FIG. 2 is an electrical curve diagram of an EL device in the related art.

Since an EL device (e.g. a light-emitting device in implementations of the present disclosure) is driven by a current, stability of a current flowing through the EL device during light emission is very important. In addition, an electrical defect caused by a process problem or a defect of an inner homogeneity of the EL device even relates directly to a yield problem. For an electrical defect, most of existing display products are repaired through physical repair or directly scrapped. However, repair with aid of circuit functions has seldom been proposed or applied. During manufacturing of a display, manufacturing of a drive circuit block and manufacturing of the EL device are separate processes. Therefore, if a current-controlled light emission function needs to be achieved, it must be implemented through a bonding process. However, the bonding process will often result in an electrical defect due to pre-process defects (for example, pollution interference, equipment errors, or other unexpected factors), which will reduce a conduction current of the EL device and thus lead to decrease in brightness. Implementations provide a pixel compensation circuit, a display substrate, and a display device. Due to establishment of a circuit via active devices, such as a metal oxide semiconductor (MOS), a field-effect transistor (thin film transistor (TFT)), and other active devices, a pixel circuit can be established on a pixel in a display area (usually referred to as an active area). Through timing control, a compensation voltage or compensation current can be provided. According to implementations, under an external compensating circuit system, a non-ideal electrical parameter of a TFT can be compensated via a compensating circuit, to stabilize a current output. In addition, with aid of switching between timing patterns, an electrical defect of an EL device on the pixel can be detected. By calculating a compensation voltage value and transmitting the compensation voltage value back to a pixel circuit, the electrical defect of the EL device on the pixel can be repaired.

In order to make objectives, technical solutions, and effects of implementations clearer, implementations will be described in detail below with reference to the accompanying drawings and specific examples. It should be understood that, implementations described herein are merely intended for explaining, rather than limiting, the disclosure.

In the implementations herein or the appended claims, unless otherwise specified, articles "a" and "the" can refer to one or multiple in general.

In addition, if involved in implementations, terms "first", "second", and the like are only used for description and cannot be understood as explicitly or implicitly indicating relative importance or implicitly indicating the number of technical features referred to herein. Therefore, features restricted by terms "first", "second", and the like can explicitly or implicitly include at least one of the features. In addition, technical solutions of various implementations can be combined with each other, but such combination must be based on what can be achieved by those of ordinary skill in the art. When there is conflict in a combination of technical solutions or the combination cannot be achieved, the combination should be considered not to exist and shall not fall within the protection scope of the disclosure.

FIG. 3 to FIG. 16 illustrate exemplary implementations of a pixel compensation circuit.

Figure 3:
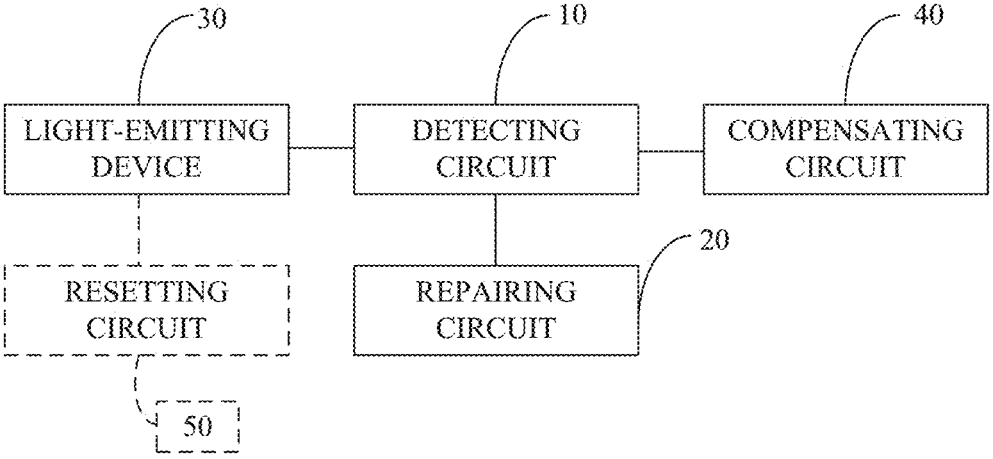
FIG. 3 is an architecture diagram illustrating functional modules of a pixel compensation circuit according to implementations.

As illustrated in FIG. 3, the pixel compensation circuit includes a detecting circuit 10, a repairing circuit 20, a compensating circuit 40, and a light-emitting device 30. The detecting circuit 10 is electrically coupled with the repairing circuit 20, the compensating circuit 40, and the light-emitting device 30. The compensating circuit 40 is configured to provide a fixed current to the light-emitting device 30 during light emission, to output a stable current to the detecting circuit 10. The detecting circuit 10 is configured to detect, with aid of switching between timing patterns, a current flowing through the light-emitting device 30. The repairing circuit 20 is configured to determine a compensation current according to the current detected by the detecting circuit 10 and input the compensation current into the light-emitting device 30. In other words, if the detecting circuit 10 detects that there is an electrical defect in the light-emitting device 30, the repairing circuit 20 applies a calculated compensation voltage back to the light-emitting device 30, to repair the electrical defect of the light-emitting device 30 on a pixel. In this way, decrease in brightness, which results from decrease in conduction current due to an electrical defect of an EL device, can be avoided, and thus yield can be improved. In some implementations, the light-emitting device 30 is an EL device.

Figure 4:
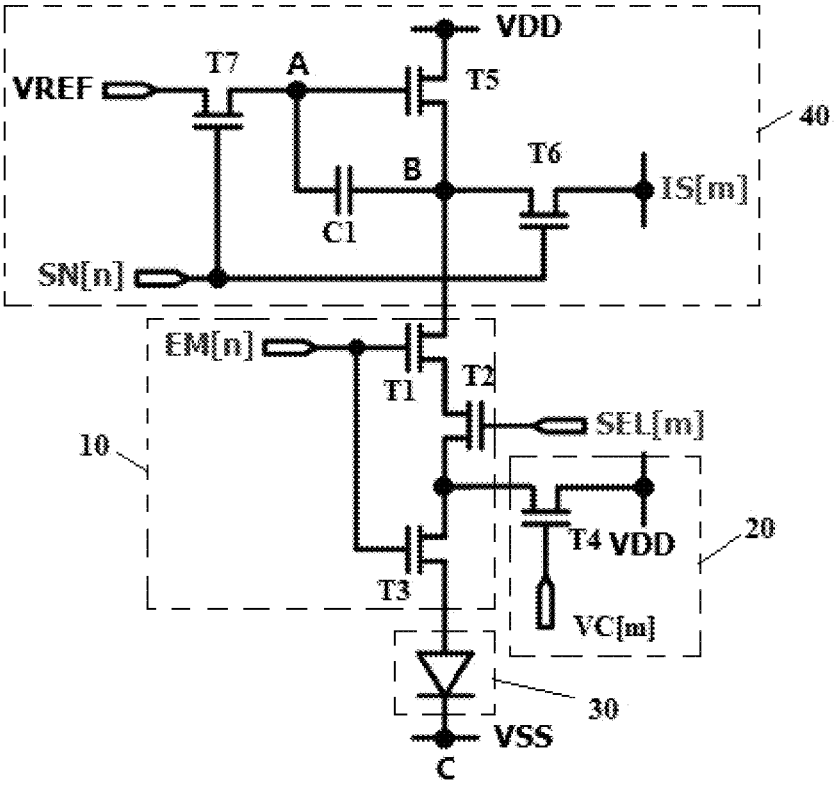
FIG. 4 is a diagram illustrating principles of a pixel compensation circuit according to implementations.

As illustrated in FIG. 4, in some implementations, the detecting circuit 10 includes a first transistor T1, a second transistor T2, and a third transistor T3. The first transistor T1 has a first end coupled with a positive electrode VDD of a power supply, a second end coupled with a first end of the second transistor T2, and a gate coupled with a light-emission control signal line. The second transistor T2 has a second end coupled with a first end of the third transistor T3 and a gate coupled with a first control signal line. The third transistor T3 has a second end coupled with an anode of the EL device. The anode of the EL device is coupled with a negative electrode VSS of the power supply. The third transistor T3 has a gate coupled with the light-emission control signal line. The repairing circuit 20 is coupled with a common connection end between the second end of the second transistor T2 and the first end of the third transistor T3. The light-emission control signal line is coupled with a common connection end between the gate of the first transistor T1 and the gate of the third transistor T3. The light-emission control signal line is configured to provide a light-emission control signal EM[n] which is used for controlling an on/off state of the first transistor T1 and the third transistor T3. The first control signal line is configured to provide a first control signal SEL[m] which is used for controlling an on/off state of the second transistor T2. When the first transistor T1, the second transistor T2, and the third transistor T3 are on, an output end of the compensating circuit 40 is coupled with an input end of the detecting circuit 10, an output end of the detecting circuit 10 is coupled with an input end (anode) of the EL device, and the compensating circuit 40 provides a fixed current to the EL device via the detecting circuit 10, to compensate a non-ideal electrical parameter of a TFT, thereby outputting a stable current to the EL device.

As illustrated in FIG. 4, in some implementations, the repairing circuit 20 includes a fourth transistor T4. The fourth transistor T4 has a first end coupled with the common connection end between the second end of the second transistor T2 and the first end of the third transistor T3, a second end coupled with the positive electrode VDD of the power supply, and a gate coupled with a repair-voltage line. The repair-voltage line is configured to provide a repair voltage VC[m]. The compensation current (fixed current) outputted by the compensating circuit 40 flows into the EL device through the detecting circuit 10. If there is an electrical defect caused by contact between the EL device and a pixel circuit, a voltage across the EL device will change, which causes a difference in brightness. Therefore, a current difference can be detected on point VSS (node C). If there is a current difference, the repair-voltage line provides a repair voltage VC to be applied to the fourth transistor T4. The repair voltage VC is usually calculated with an external circuit, an electrical database, a look-up table, or through an algorithm, and then whether a consistent current value (here, the consistent current value refers to a current value of the EL device under a normal condition, that is, when there is no electrical defect) has been reached through repair can be detected on point VSS. Electrical data of the EL device have been recorded before the EL device leaves the factory.

As illustrated in FIG. 4, in some implementations, the compensating circuit 40 includes a fifth transistor T5, a sixth transistor T6, a seventh transistor T7, and a first capacitor C1. The fifth transistor T5 has a first end coupled with the positive electrode VDD of the power supply, a second end coupled with the detecting circuit 10, and a gate coupled with a first end of the first capacitor C1. The sixth transistor T6 has a first end coupled with a second end of the first capacitor C1, a second end coupled with an adjustable-fixed-current line, and a gate coupled with a scanning control signal line. The seventh transistor T7 has a first end coupled with a reference voltage line, a second end coupled with the first end of the first capacitor, and a gate coupled with the scanning control signal line. The second end of the first capacitor C1 is coupled with the first end of the first transistor T1. The first end of the first capacitor C1 is coupled with a common connection end between the gate of the fifth transistor T5 and the second end of the seventh transistor T7. The second end of the first capacitor C1 is coupled with a common connection end between the first end of the first transistor T1, the second end of the fifth transistor T5, and the first end of the sixth transistor T6. The scanning control signal line is coupled with a common connection end between the gate of the seventh transistor T7 and the gate of the sixth transistor T6. The adjustable-fixed-current line is configured to provide an adjustable fixed current IS[m], where IS[m] is an adjustable fixed current. Adjustment can be made to a fixed current by adjusting a IS current source, to compensate a non-ideal electrical parameter of a TFT, thereby outputting a stable current during light emission. The reference voltage line is configured to provide a reference voltage VREF. The scanning control signal line is configured to provide a second control signal SN[n] which is used for controlling an on/off state of the sixth transistor T6 and the seventh transistor T7. When the second control signal is at a high level, a voltage of the TFT is set to be Vg, that is, a voltage of node A is Vg, and a value of Vg is equal to that of the reference voltage VREF. When the adjustable-fixed-current line provides an adjustable fixed current which flows through the fifth transistor T5, a voltage of node B is set to be Vs, and accordingly, voltage Vs will be adjusted. Voltage Vs can provide a fixed current to the EL device during light emission, to achieve compensation for the first transistor T1. The above process can be elaborated with the following formulas:

$$Vg=V\mathrm{REF};$$

$Vs=V\mathrm{REF}-|V\mathrm{th}|-\Delta Vs$, where $V\mathrm{th}$ is an electrical parameter of the fifth transistor $T5$;

a current of the fifth transistor can be expressed as follows:

$I_{T1}=k\times(|Vgs|-|V\mathrm{th}|)^2=k\times(\Delta Vs)^2$, where $k$ is a conductance coefficient.

Figure 5:
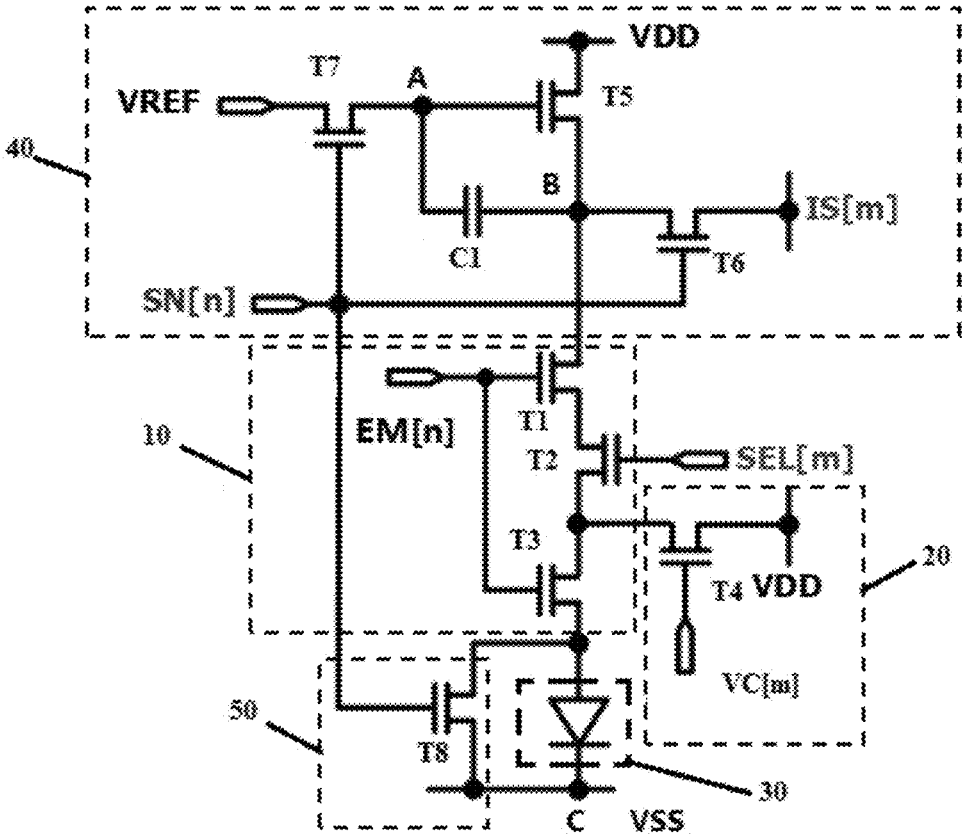
FIG. 5 is a diagram illustrating principles of a pixel compensation circuit according to other implementations.

As illustrated in FIG. 5, in some implementations, the pixel compensation circuit further includes a resetting module 50. The resetting module 50 is electrically coupled with the scanning control signal line, the anode of the EL device, and the negative electrode of the power supply and is configured to reset the EL device. In some implementations, the resetting module 50 includes an eighth transistor T8. The eighth transistor T8 has a first end coupled with the anode of the EL device, a second end coupled with the negative electrode VSS of the power supply, and a gate coupled with the scanning control signal line. The first end of the eighth transistor T8 is coupled with a common connection end between the second end of the third transistor T3 and the anode of the light-emitting device 30 (the black point between the second end of T3 and the anode of the light-emitting device 30 in FIG. 5). The scanning control signal line is configured to provide a second control signal SN[n]. When the second control signal is at a high level, the eighth transistor T8 is on. The eighth transistor T8 turns on the EL device from a high voltage end (anode) to a low voltage end before light emission, to reset the EL device, thereby avoiding crosstalk caused by operations before light emission.

In some implementations, the first transistor T1, the second transistor T2, the third transistor T3, the fourth transistor T4, the fifth transistor T5, the sixth transistor T6, the seventh transistor T7, and the eighth transistor T8 are each an N-type transistor.

Figure 6:
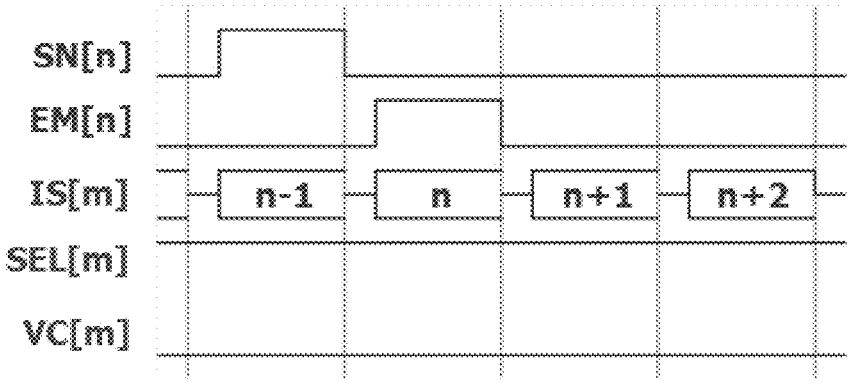
FIG. 6 is a timing diagram of detection of an electrical defect in timing operations of a pixel compensation circuit according to implementations.
Figure 7:
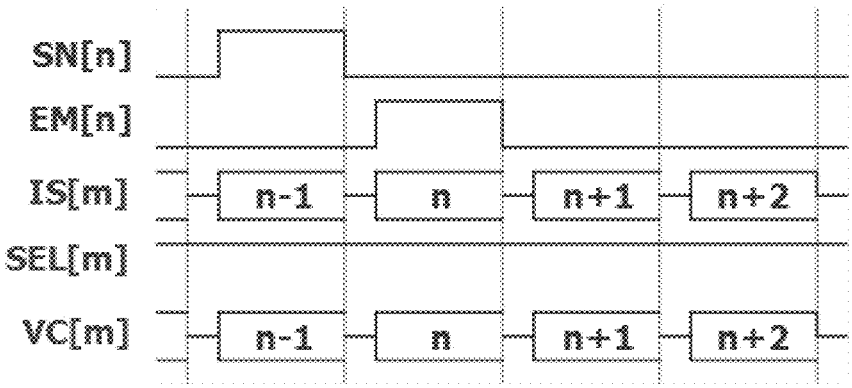
FIG. 7 is a timing diagram of application and confirmation of an electrical repair voltage in timing operations of a pixel compensation circuit according to implementations.
Figure 8:
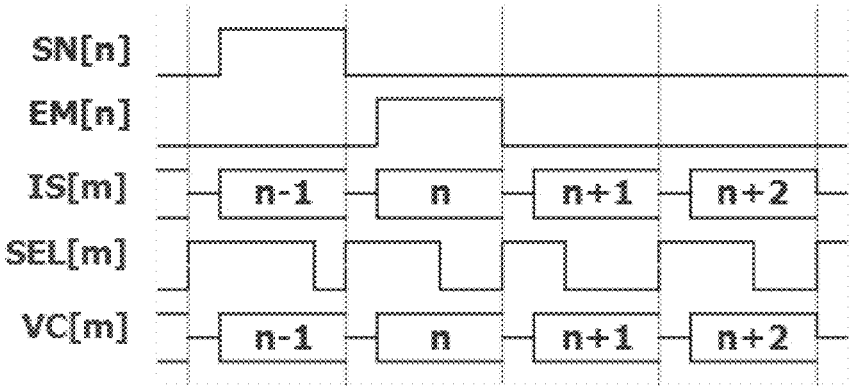
FIG. 8 is a timing diagram of light emission for display in timing operations of a pixel compensation circuit according to implementations.

For better understanding of the implementations, the following will describe the implementations in further detail in connection with timing operations with reference to FIG. 6, FIG. 7, and FIG. 8.

Figure 9:
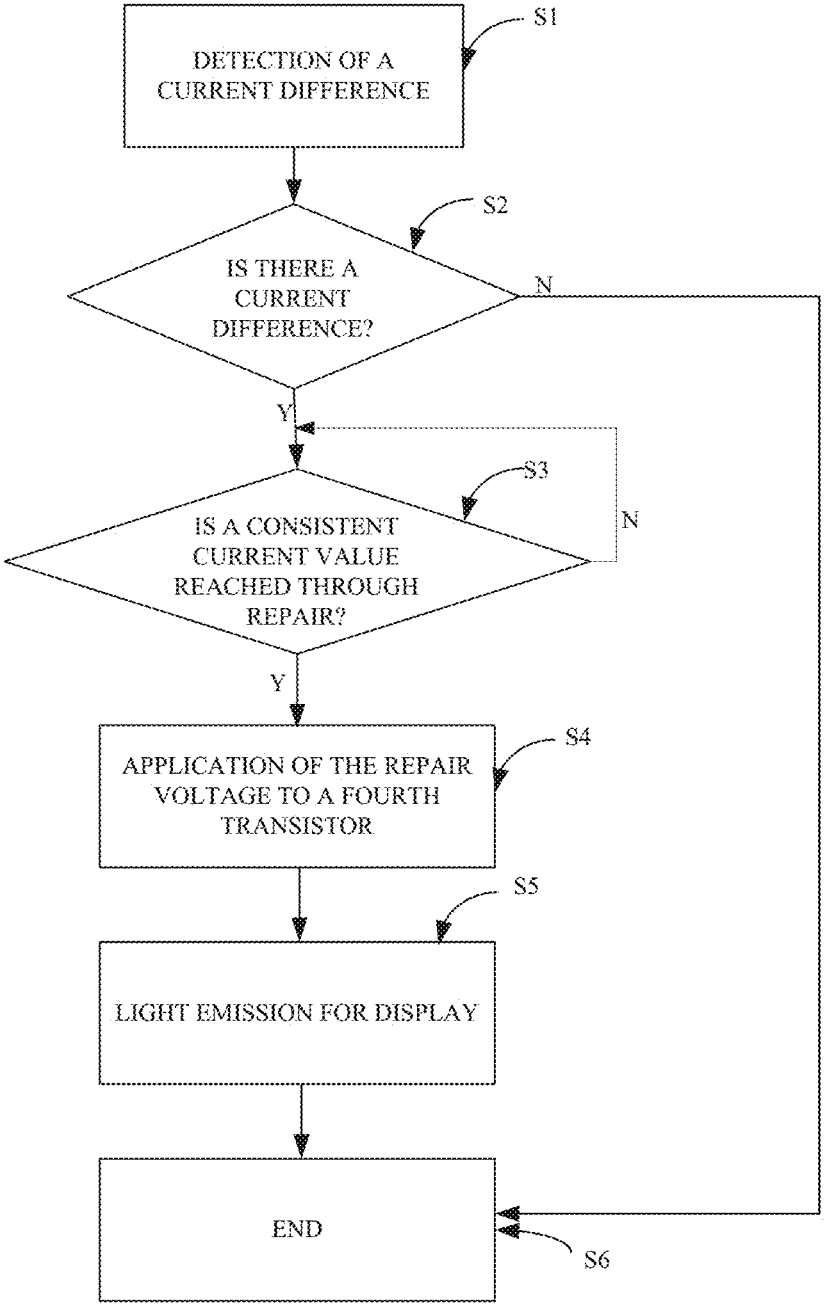
FIG. 9 is a flowchart of electrical compensation operations according to implementations.

Electrical compensation operations include the following steps: step 1, detection of an electrical defect (e.g. operations at block S1 and S2); step 2, application and confirmation of an electrical repair voltage (e.g. operations at block S3 and S4); step 3, light emission after the application of the electrical repair voltage (e.g. operations at block S5). As illustrated in FIG. 9, the electrical compensation operations include the following.

At block S1, a current difference is detected.

At block S2, whether there is a current difference is determined. If yes, determine that there is an electrical defect, and proceed to operations at block S3. If not, proceed to operations at block S5.

At block S3, a current value subjected to repair is compared with a current value under a normal condition (here, the normal condition refers to a situation where there is no electrical defect), and whether a consistent current value has been reached through repair (that is, whether the repair voltage has repaired the current value subjected to repair back to the current value under the normal condition) is determined. If yes, proceed to operations at block S4. If not, return to operations at block S3.

At block S4, the repair voltage is applied to the fourth transistor T4.

At block S5, light emission for display.

At block S6, end.

According to implementations, through detection of an electrical defect, application and confirmation of the electrical repair voltage, and light emission after the application of the electrical repair voltage, it is possible to solve a problem of difference in brightness during light emission of the EL device caused by an electrical defect. IS is an adjustable fixed current, VC is a repair voltage calculated with a database, and SEL is a pulse width modulation (PWM) signal which is used for determining grayscale and brightness in light emission. A detailed process of electrical compensation is as follows.

Step 1, detection of an electrical defect, which includes the following.

Figure 10:
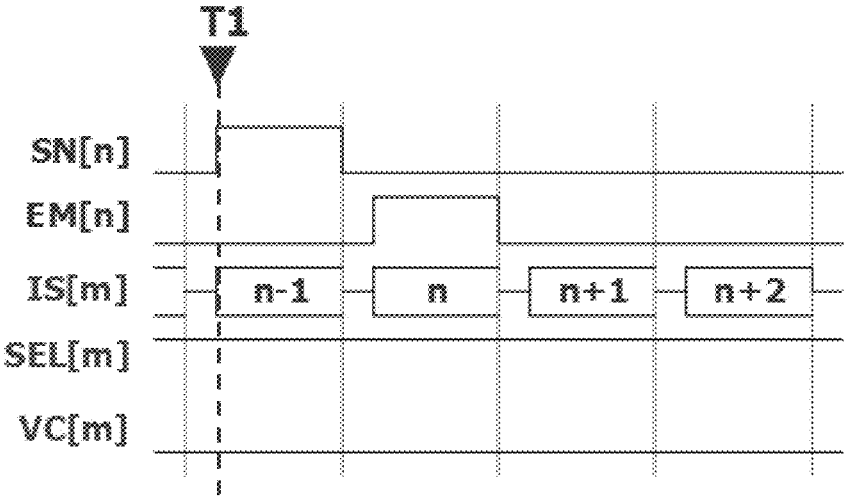
FIG. 10 is a timing diagram of time point T1 in FIG. 6.
Figure 11:
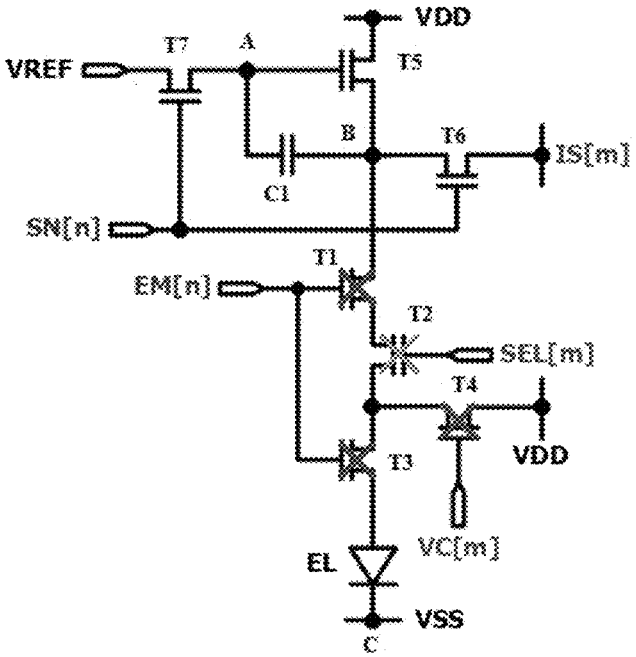
FIG. 11 is a diagram of a pixel compensation circuit corresponding to time point T1 in FIG. 10.

As illustrated in FIG. 10 and FIG. 11, voltage Vg of a TFT (node A) is set at time point T1. An adjustable fixed current is extracted via IS to flow through the fifth transistor T5, and accordingly, voltage Vs of node B is adjusted, which can be expressed by a formula related to electrical parameter |Vth| of the fifth transistor T5. Voltage Vs can provide a fixed current to the EL device during light emission, thereby achieving compensation operations on the TFT. The relationship between these nodes can be expressed in detail with the following formulas:

$$Vg=V\mathrm{REF};$$

$Vs=V\mathrm{REF}-|V\mathrm{th}|-\Delta Vs$, where $V\mathrm{th}$ is an electrical parameter of the fifth transistor $T5$;

a current of the fifth transistor T5 can be expressed as follows:

$I_{T1}=k\times(|Vgs|-|V\mathrm{th}|)^2=k\times(\Delta Vs)^2$, where $k$ is a conductance coefficient.

FIG. 11 illustrates a pixel compensation circuit for detecting an electrical defect, that is, FIG. 11 is a diagram of a pixel compensation circuit corresponding to time point T1 in FIG. 10. At time point T1, as illustrated in FIG. 11, since EM[n] is at a low level, the first transistor T1, the second transistor T2, the third transistor T3, and the fourth transistor T4 are at a low level and therefore are in an off state (represented by "x" in FIG. 11). Since SN[n] is at a high level, the sixth transistor T6 and the seventh transistor T7 are in an on state.

Figure 12:
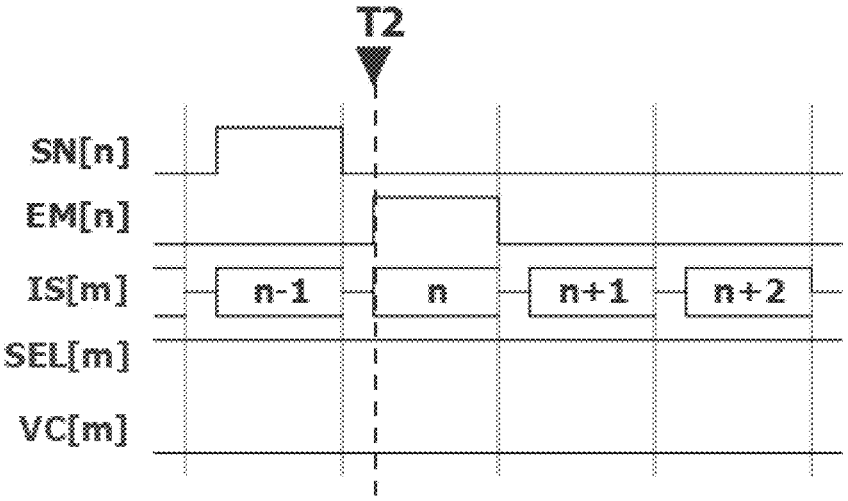
FIG. 12 is a timing diagram of time point T2 in FIG. 6.
Figure 13:
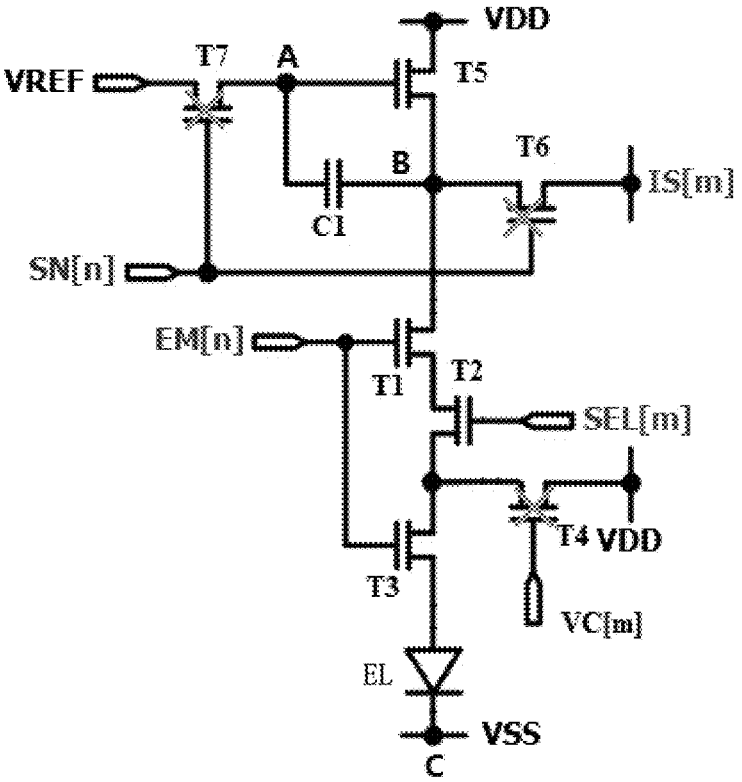
FIG. 13 is a diagram of a pixel compensation circuit corresponding to time point T2 in FIG. 12.

As illustrated in FIG. 12 and FIG. 13, at time point T2, a compensation current of the TFT flows through the EL device. According to a contact condition of the EL device and a circuit that is connected with the EL device, if there is an electrical defect, a voltage across the EL device will change, causing a difference in brightness. The current difference can be detected on point VSS (node C). If there is a current difference, subsequent repairs can be performed.

The voltage across the EL device is VA−VSS under the normal condition. If there is an electrical defect, the voltage across the EL device is VA−VSS−ΔV, which is lower than the voltage under the normal condition and thus will result in decrease in current. FIG. 13 is a diagram of a pixel compensation circuit corresponding to time point T2 in FIG. 12. Since SN[n] is at a low level, the sixth transistor T6 and the seventh transistor T7 are in an off state. Since EM[n] is at a high level, the first transistor T1, the second transistor T2, and the third transistor T3 are in an on state. The fourth transistor T4 is in an off state due to detection of an electrical defect.

Figure 14:
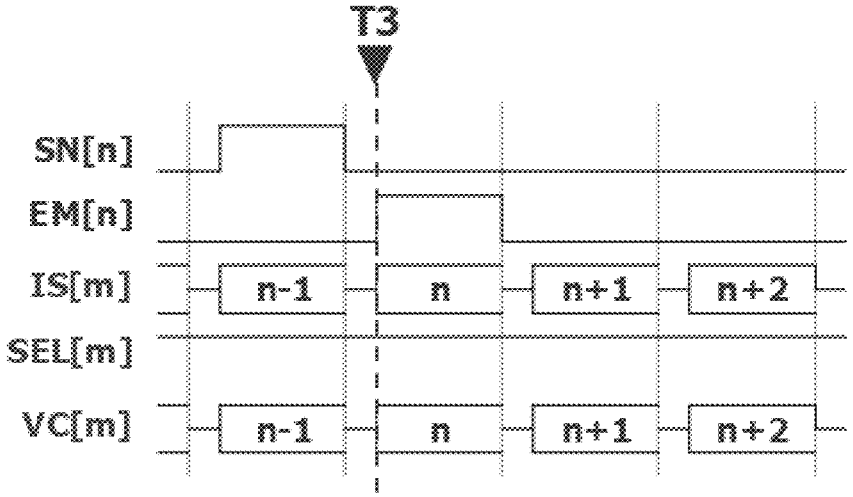
FIG. 14 is a timing diagram of time point T3 in FIG. 7.
Figure 15:
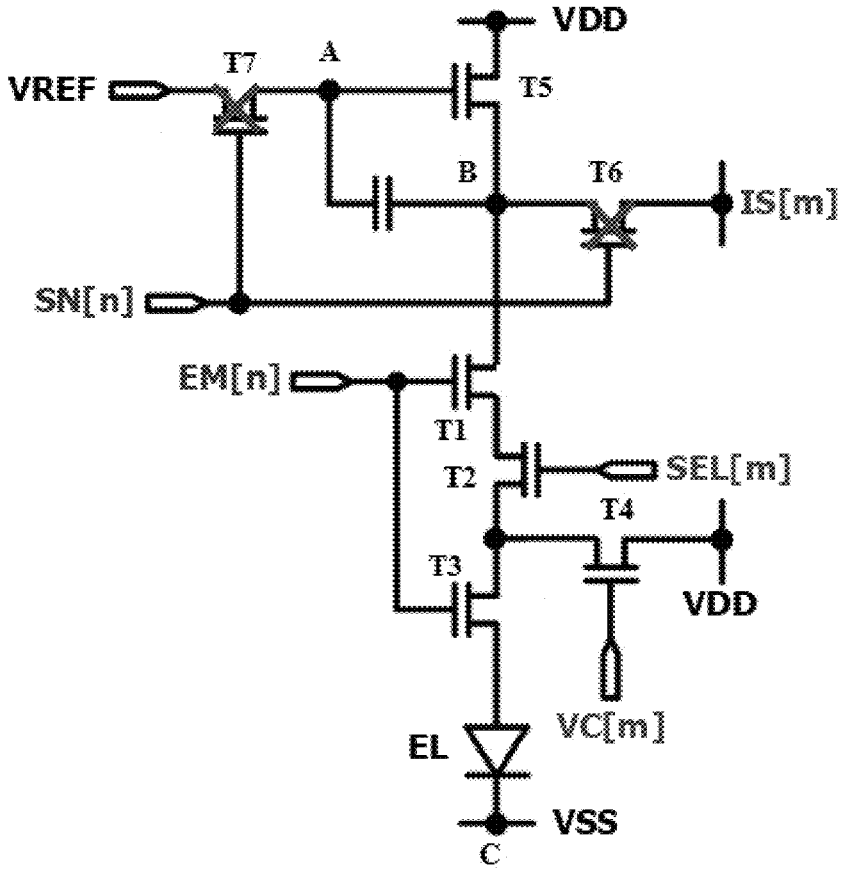
FIG. 15 is a diagram of a pixel compensation circuit corresponding to time point T3 in FIG. 14.

Step 2, electrical repair and confirmation. As illustrated in FIG. 14 and FIG. 15, VC is a repair voltage. After detection of an electrical defect at stage 2, at time point T3, the current value subjected to repair is compared with the current value under the normal condition, to calculate a repair voltage for compensating such a current difference and apply the repair voltage to the fourth transistor T4. Repair voltage VC is usually calculated with an external circuit, an electrical database, and a look-up table or through an algorithm, and then whether a consistent current value has been reached through repair can be detected on point VSS (node C). Electrical data of the EL device have been recorded before the EL device leaves the factory.

If a current of the EL device under the normal condition is $I_{EL}$ and a current of the EL device when there is an electrical defect (before repair) is $I_{EL}-\Delta I$, a current of the EL device when there is an electrical defect (after repair) should be $I_{EL}-\Delta I+\Delta I=I_{EL}$, where repair current ΔI is provided via the fourth transistor T4. As illustrated in FIG. 15, since SN[n] is at a low level, the sixth transistor T6 and the seventh transistor T7 are in an off state. Since EM[n] is at a high level, the first transistor T1, the second transistor T2, and the third transistor T3 are in an on state. Since repair current ΔI is provided via the fourth transistor T4, the fourth transistor is in an on state.

Figure 16:
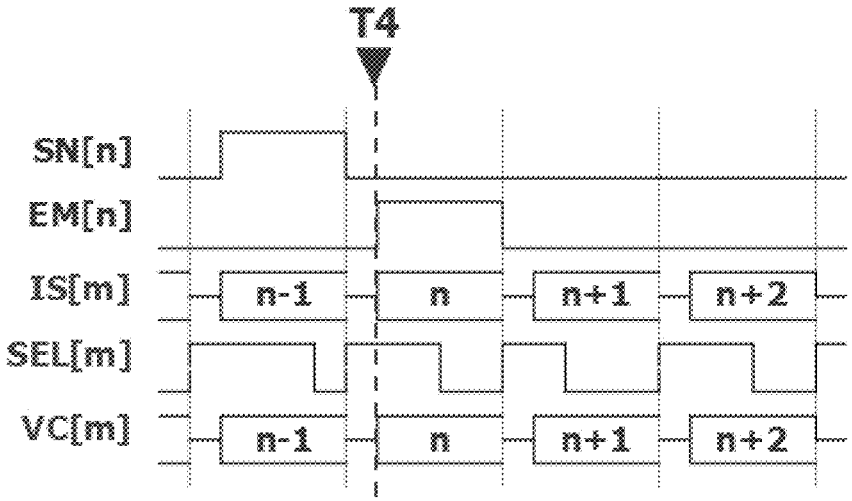
FIG. 16 is a timing diagram of time point T4 in FIG. 8.

Step 3, light emission for display, that is. As illustrated in FIG. 15 and FIG. 16, at time point T4, repair voltage VC, after being confirmed in previous operations, is stored to be subsequently applied to display operations, to complete the electrical compensation operations along with a TFT compensation function of the original circuit and an electrical repair function of the EL device. The second transistor T2 switches light emission times, to reflect different grayscales and brightnesses. As to a current of the EL device, a current provided by a TFT is $I_{T1}=k\times(\Delta Vs)^2$, and a current received by the EL device is $I_{EL}=I_{T1}$. As illustrated in FIG. 15, since SN[n] is at a low level, the sixth transistor T6 and the seventh transistor T7 are in an off state. Since EM[n] is at a high level, the first transistor T1, the second transistor T2, and the third transistor T3 are in an on state. Since repair current ΔI is provided via the fourth transistor T4, the fourth transistor is in an on state.

As illustrated in FIG. 18 to FIG. 22, the first transistor T1, the second transistor T2, the third transistor T3, the fourth transistor T4, the fifth transistor T5, the sixth transistor T6, the seventh transistor T7, and the eighth transistor T8 each may also be a P-type transistor. When applied to the pixel compensation circuit, the working principles of the P-type transistor are the same as those of the N-type transistor, which will not be repeated herein.

The first end of the first transistor T1 may be a source or a drain. Similarly, the second end of the first transistor T1 may be a drain or a source. In other words, if the first end of the first transistor T1 is a source, the second end of the first transistor T1 is a drain, and on the contrary, if the first end of the first transistor T1 is a drain, the second end of the first transistor T1 is a source.

It should be understood that, for the configuration of the first end and the second end of each of the second transistor T2, the third transistor T3, the fourth transistor T4, the fifth transistor T5, the sixth transistor T6, the seventh transistor T7, and the eighth transistor T8, reference can be made to the configuration of the first end and the second end of the first transistor T1. For example, if the first end of the second transistor T2 is a source, the second end of the second transistor T2 is a drain, and on the contrary, if the first end of the second transistor T2 is a drain, the second end of the second transistor T2 is a source. If the first end of the third transistor T3 is a source, the second end of the third transistor T3 is a drain, and on the contrary, if the first end of the third transistor T3 is a drain, the second end of the third transistor T3 is a source, which will not be further repeated herein.

Figure 17:
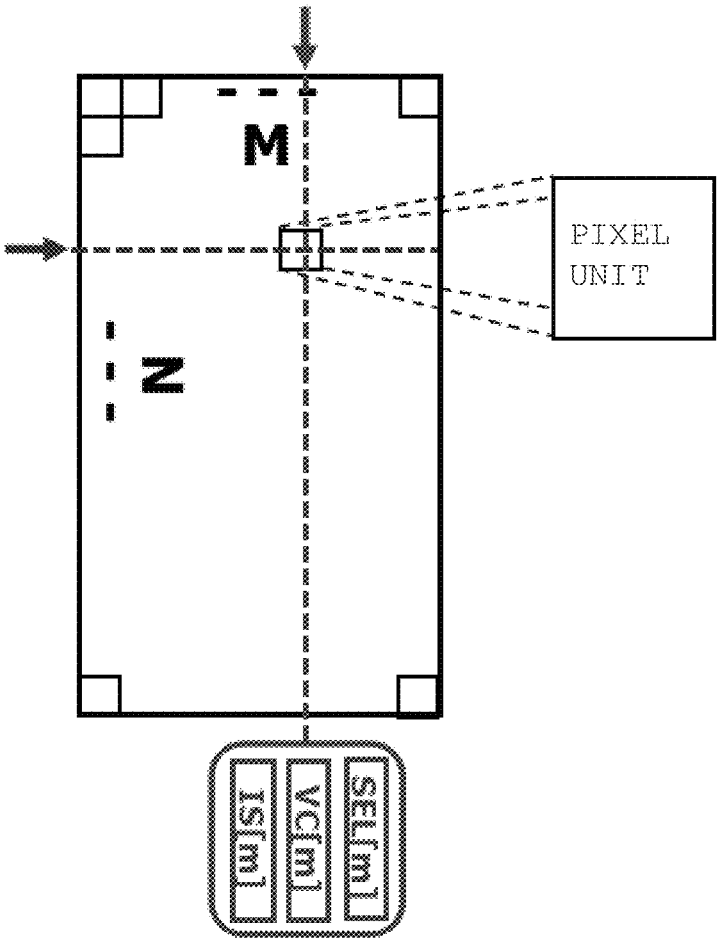
FIG. 17 is a schematic structural diagram of a display substrate according to implementations.
Figure 18:
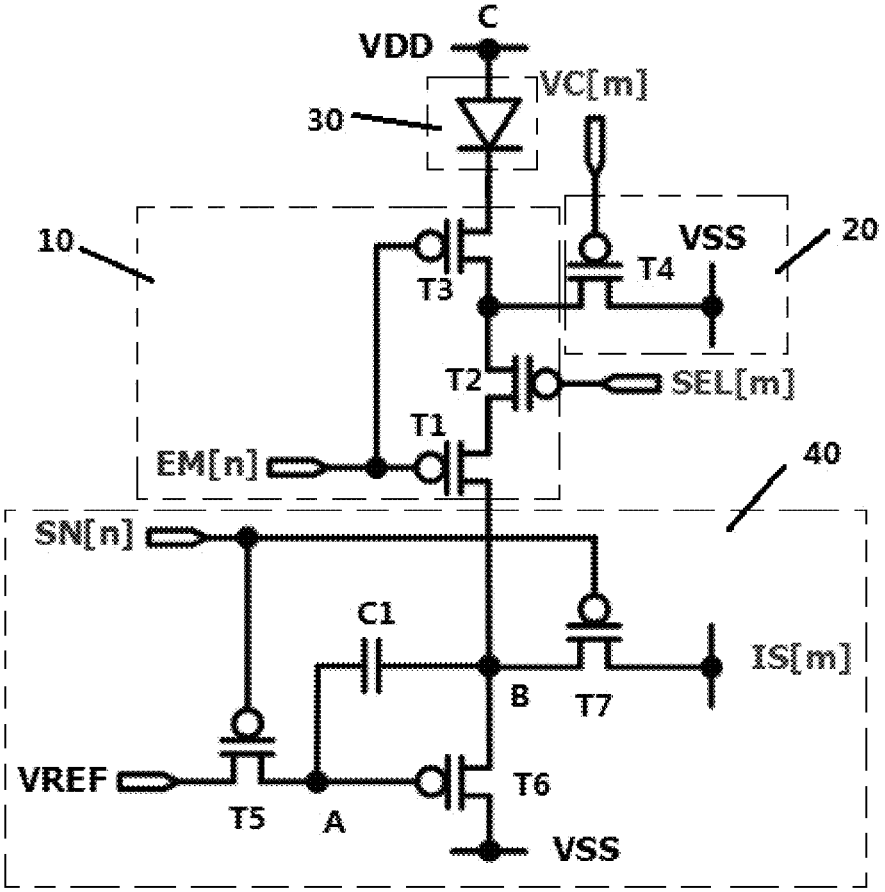
FIG. 18 is a diagram illustrating principles of a pixel compensation circuit according to other implementations.
Figure 19:
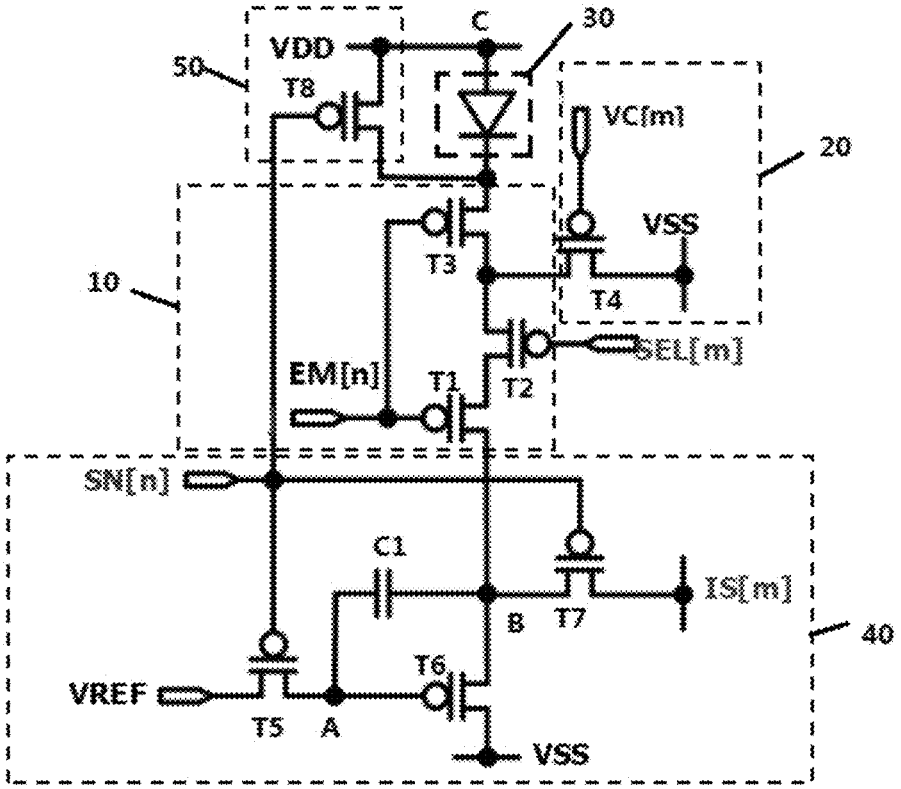
FIG. 19 is a diagram illustrating principles of a pixel compensation circuit according to other implementations.
Figure 20:
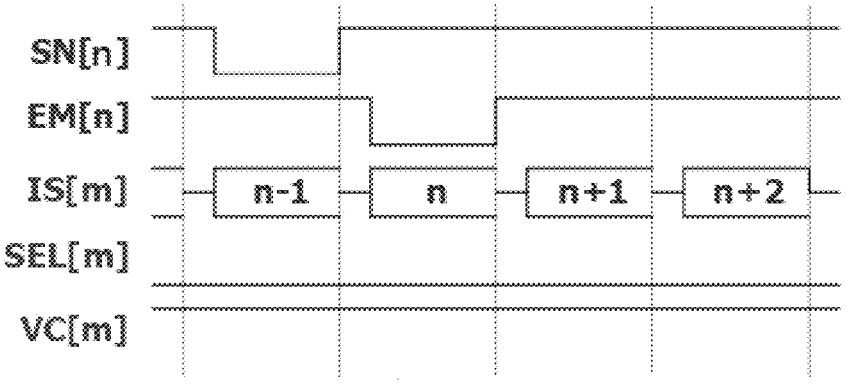
FIG. 20 is a timing diagram of detection of an electrical defect in timing operations of a pixel compensation circuit according to other implementations.
Figure 21:
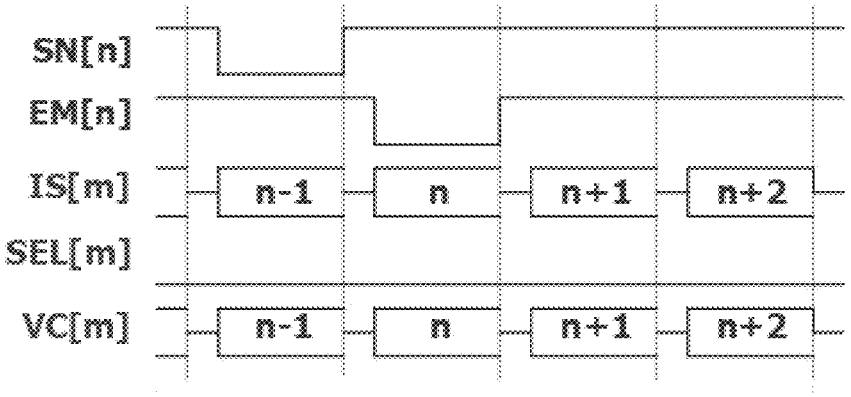
FIG. 21 is a timing diagram of application and confirmation of an electrical repair voltage in timing operations of a pixel compensation circuit according to other implementations.
Figure 22:
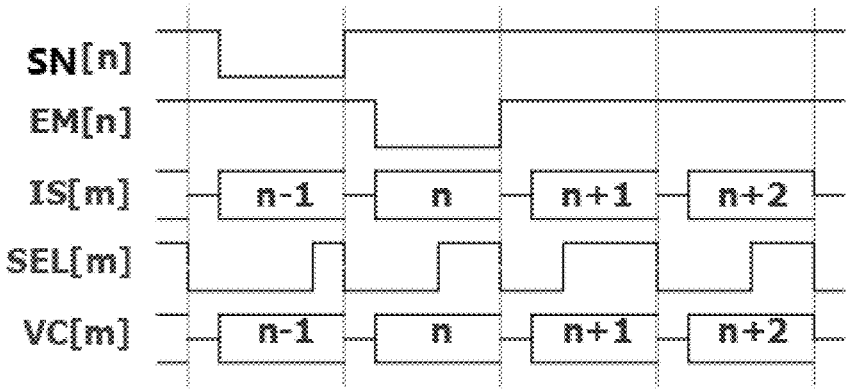
FIG. 22 is a timing diagram of light emission for display in timing operations of a pixel compensation circuit according to other implementations.

FIG. 17 illustrates a display substrate. The display substrate includes multiple pixel units. Each of the multiple pixel units includes the pixel compensation circuit described above, which will not be repeated herein.

Implementations further provide a display device. The display device includes a display substrate. The display substrate includes multiple pixel units. Each of the multiple pixel units includes the pixel compensation circuit described above, which will not be repeated herein.

The "n" in EM[n] and SN[n] represents the number of rows, and the "m" in IS[m], VC[m], and SEL[m] represents the number of columns. In other words, n and m can indicate that there are n rows and m columns of pixel units on a display device. The value of each of n and m can be determined according to actual needs and will not be specifically limited herein.

Implementations provide a pixel compensation circuit, a display substrate, and a display device. The pixel compensation circuit includes the detecting circuit, the repairing circuit, and the light-emitting device. The detecting circuit is electrically coupled with the repairing circuit, the compensating circuit, and the light-emitting device. The compensating circuit is configured to provide a fixed current to the light-emitting device. The detecting circuit is configured to detect the current flowing through the light-emitting device. The repairing circuit is configured to determine the compensation current according to the current detected by the detecting circuit and input the compensation current into the light-emitting device. According to implementations, based on an architecture of an external compensating system, an intra-panel pixel compensation circuit that is capable of repairing an electrical defect of the light-emitting device is established. Through adjustment of an adjustable fixed current, a non-ideal electrical parameter of a TFT can be compensated, to output a stable current during light emission. In addition, by detecting an electrical defect, with aid of a given repair voltage, a non-ideal characteristic of the light-emitting device caused by electrical defect can be electrically repaired, to repair an electrical defect of the light-emitting device on a pixel. This can avoid decrease in brightness, which results from decrease in conduction current due to an electrical defect of the EL device, and thus yield can be improved.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A pixel compensation circuit comprising:

a light-emitting device;

a compensating circuit configured to provide a fixed current to the light-emitting device;

a detecting circuit electrically coupled with the light-emitting device, the compensating circuit, and a repairing circuit and configured to detect a current flowing through the light-emitting device;

the repairing circuit configured to determine a compensation current according to the current detected by the detecting circuit and input the compensation current into the light-emitting device;

wherein the detecting circuit comprises a first transistor, a second transistor, and a third transistor, wherein the first transistor has a first end coupled with a positive electrode of a power supply, a second end coupled with a first end of the second transistor, and a gate coupled with a light-emission control signal line, the second transistor has a second end coupled with a first end of the third transistor and a gate coupled with a first control signal line, and the third transistor has a second end coupled with an anode of the light-emitting device and a gate coupled with the light-emission control signal line;

the light-emission control signal line is configured to provide a light-emission control signal which is used for controlling an on/off state of the first transistor and the third transistor, the first control signal line is configured to provide a first control signal which is used for controlling an on/off state of the second transistor, and the repairing circuit is coupled with a common connection end between the second end of the second transistor and the first end of the third transistor;

wherein the repairing circuit comprises a fourth transistor, wherein the fourth transistor has a first end coupled with the common connection end between the second end of the second transistor and the first end of the third transistor, a second end coupled with the positive electrode of the power supply, and a gate coupled with a repair-voltage line;

wherein the compensating circuit comprises a fifth transistor, a sixth transistor, a seventh transistor, and a first capacitor, wherein the fifth transistor has a first end coupled with the positive electrode of the power supply, a second end coupled with a second end of the first capacitor, and a gate coupled with a first end of the first capacitor;

the sixth transistor has a first end coupled with the second end of the first capacitor, a second end coupled with an adjustable-fixed-current line, and a gate coupled with a scanning control signal line;

the seventh transistor has a first end coupled with a reference voltage line, a second end coupled with the first end of the first capacitor, and a gate coupled with the scanning control signal line; and the second end of the first capacitor is coupled with the first end of the first transistor.

2. The pixel compensation circuit of claim 1, further comprising:

a resetting module electrically coupled with the scanning control signal line, the anode of the light-emitting device, and a negative electrode of the power supply and configured to reset the light-emitting device.

3. The pixel compensation circuit of claim 2, wherein the resetting module comprises an eighth transistor, wherein the eighth transistor has a first end coupled with the anode of the light-emitting device, a second end coupled with the negative electrode of the power supply, and a gate coupled with the scanning control signal line; and the scanning control signal line is configured to provide a second control signal which is used for controlling an on/off state of the sixth transistor, the seventh transistor, and the eighth transistor.

4. The pixel compensation circuit of claim 3, wherein the first transistor, the second transistor, the third transistor, the fourth transistor, the fifth transistor, the sixth transistor, the seventh transistor, and the eighth transistor are each an N-type transistor.

5. The pixel compensation circuit of claim 3, wherein the first transistor, the second transistor, the third transistor, the fourth transistor, the fifth transistor, the sixth transistor, the seventh transistor, and the eighth transistor are each an P-type transistor.

6. The pixel compensation circuit of claim 1, wherein the light-emitting device is an electroluminescence (EL) device.

7. A display substrate, comprising a plurality of pixel units, each of the plurality of pixel units comprising a pixel compensation circuit, wherein the pixel compensation circuit comprises:

a light-emitting device;

a compensating circuit configured to provide a fixed current to the light-emitting device;

a detecting circuit electrically coupled with the light-emitting device, the compensating circuit, and a repairing circuit and configured to detect a current flowing through the light-emitting device;

the repairing circuit configured to determine a compensation current according to the current detected by the detecting circuit and input the compensation current into the light-emitting device;

wherein the detecting circuit comprises a first transistor, a second transistor, and a third transistor, wherein the first transistor has a first end coupled with a positive electrode of a power supply, a second end coupled with a first end of the second transistor, and a gate coupled with a light-emission control signal line, the second transistor has a second end coupled with a first end of the third transistor and a gate coupled with a first control signal line, and the third transistor has a second end coupled with an anode of the light-emitting device and a gate coupled with the light-emission control signal line;

the light-emission control signal line is configured to provide a light-emission control signal which is used for controlling an on/off state of the first transistor and the third transistor, the first control signal line is configured to provide a first control signal which is used for controlling an on/off state of the second transistor, and the repairing circuit is coupled with a common connection end between the second end of the second transistor and the first end of the third transistor;

wherein the repairing circuit comprises a fourth transistor, wherein the fourth transistor has a first end coupled with the common connection end between the second end of the second transistor and the first end of the third transistor, a second end coupled with the positive electrode of the power supply, and a gate coupled with a repair-voltage line;

wherein the compensating circuit comprises a fifth transistor, a sixth transistor, a seventh transistor, and a first capacitor, wherein the fifth transistor has a first end coupled with the positive electrode of the power supply, a second end coupled with a second end of the first capacitor, and a gate coupled with a first end of the first capacitor;

the sixth transistor has a first end coupled with the second end of the first capacitor, a second end coupled with an adjustable-fixed-current line, and a gate coupled with a scanning control signal line;

the seventh transistor has a first end coupled with a reference voltage line, a second end coupled with the first end of the first capacitor, and a gate coupled with the scanning control signal line; and the second end of the first capacitor is coupled with the first end of the first transistor.

8. The display substrate of claim 7, wherein the pixel compensation circuit further comprises:

a resetting module electrically coupled with the scanning control signal line, the anode of the light-emitting device, and a negative electrode of the power supply and configured to reset the light-emitting device.

9. The display substrate of claim 8, wherein the resetting module comprises an eighth transistor, wherein the eighth transistor has a first end coupled with the anode of the light-emitting device, a second end coupled with the negative electrode of the power supply, and a gate coupled with the scanning control signal line; and the scanning control signal line is configured to provide a second control signal which is used for controlling an on/off state of the sixth transistor, the seventh transistor, and the eighth transistor.

10. The display substrate of claim 9, wherein the first transistor, the second transistor, the third transistor, the fourth transistor, the fifth transistor, the sixth transistor, the seventh transistor, and the eighth transistor are each an N-type transistor or an P-type transistor.

11. A display device, comprising a display substrate, the display substrate comprising a plurality of pixel units, each of the plurality of pixel units comprising a pixel compensation circuit, wherein the pixel compensation circuit comprises:

a light-emitting device;

a compensating circuit configured to provide a fixed current to the light-emitting device;

a detecting circuit electrically coupled with the light-emitting device, the compensating circuit, and a repairing circuit and configured to detect a current flowing through the light-emitting device;

the repairing circuit configured to determine a compensation current according to the current detected by the detecting circuit and input the compensation current into the light-emitting device;

wherein the detecting circuit comprises a first transistor, a second transistor, and a third transistor, wherein the first transistor has a first end coupled with a positive electrode of a power supply, a second end coupled with a first end of the second transistor, and a gate coupled with a light-emission control signal line, the second transistor has a second end coupled with a first end of the third transistor and a gate coupled with a first control signal line, and the third transistor has a second end coupled with an anode of the light-emitting device and a gate coupled with the light-emission control signal line;

the light-emission control signal line is configured to provide a light-emission control signal which is used for controlling an on/off state of the first transistor and the third transistor, the first control signal line is configured to provide a first control signal which is used for controlling an on/off state of the second transistor, and the repairing circuit is coupled with a common connection end between the second end of the second transistor and the first end of the third transistor;

wherein the repairing circuit comprises a fourth transistor, wherein the fourth transistor has a first end coupled with the common connection end between the second end of the second transistor and the first end of the third transistor, a second end coupled with the positive electrode of the power supply, and a gate coupled with a repair-voltage line;

wherein the compensating circuit comprises a fifth transistor, a sixth transistor, a seventh transistor, and a first capacitor, wherein the fifth transistor has a first end coupled with the positive electrode of the power supply, a second end coupled with a second end of the first capacitor, and a gate coupled with a first end of the first capacitor;

the sixth transistor has a first end coupled with the second end of the first capacitor, a second end coupled with an adjustable-fixed-current line, and a gate coupled with a scanning control signal line;

the seventh transistor has a first end coupled with a reference voltage line, a second end coupled with the first end of the first capacitor, and a gate coupled with the scanning control signal line; and the second end of the first capacitor is coupled with the first end of the first transistor.

* * * * *